US009422720B2

(12) United States Patent
Shevlin

(10) Patent No.: US 9,422,720 B2
(45) Date of Patent: Aug. 23, 2016

(54) NON-PENETRATING ROOF MOUNT FOR A MEMBRANE ROOF

(71) Applicant: William Edwin Shevlin, Santa Cruz, CA (US)

(72) Inventor: William Edwin Shevlin, Santa Cruz, CA (US)

(73) Assignee: Renewable Elements, LLC, San Jose, CA (US)

( * ) Notice: Subject to any disclaimer, the term of this patent is extended or adjusted under 35 U.S.C. 154(b) by 0 days.

(21) Appl. No.: 14/448,798

(22) Filed: Jul. 31, 2014

(65) Prior Publication Data

US 2016/0032590 A1 Feb. 4, 2016

(51) Int. Cl.
*E04D 5/14* (2006.01)

(52) U.S. Cl.
CPC ..... *E04D 5/147* (2013.01); *E04D 5/145* (2013.01); *E04D 5/149* (2013.01)

(58) Field of Classification Search
CPC ..... E04D 5/142; E04D 5/145; E04D 5/147; E04D 13/1407; E04D 13/1415; E04D 13/155; E04D 5/149; E04B 1/62; F24J 2/5245; F24J 2002/5294; Y02E 10/47
USPC ..... 52/25, 58–62, 506.05, 173.3, 793.1, 52/787.1, 796.1, 408–411
See application file for complete search history.

(56) References Cited

U.S. PATENT DOCUMENTS

| | | | | |
|---|---|---|---|---|
| 4,321,745 | A * | 3/1982 | Ford | 29/525.04 |
| 4,619,094 | A * | 10/1986 | Yang | 52/410 |
| 4,630,422 | A * | 12/1986 | Beneze | 52/410 |
| 4,651,490 | A * | 3/1987 | Marston | 52/410 |
| 4,778,702 | A * | 10/1988 | Hutter, III | 428/40.9 |
| 6,845,590 | B1 * | 1/2005 | Mills, Jr. | 52/60 |
| 6,922,951 | B1 * | 8/2005 | Inzeo et al. | 52/94 |
| 7,413,392 | B2 * | 8/2008 | Nebesnak et al. | 411/531 |
| 8,122,648 | B1 * | 2/2012 | Liu | 52/58 |
| 8,387,337 | B2 * | 3/2013 | Hamlin, III | 52/741.4 |
| 8,752,338 | B2 * | 6/2014 | Schaefer et al. | 52/60 |
| 8,935,893 | B2 * | 1/2015 | Liu et al. | 52/173.3 |
| 2012/0138208 | A1 * | 6/2012 | Stanley | 156/66 |
| 2012/0204508 | A1 * | 8/2012 | Kalwara et al. | 52/309.3 |
| 2012/0233958 | A1 * | 9/2012 | Stearns | 52/708 |
| 2013/0009025 | A1 * | 1/2013 | Stearns | 248/237 |
| 2013/0074441 | A1 * | 3/2013 | Stearns | 52/705 |
| 2013/0298494 | A1 * | 11/2013 | Corsi | 52/705 |
| 2014/0305046 | A1 * | 10/2014 | Stearns et al. | 52/58 |
| 2014/0331594 | A1 * | 11/2014 | Stearns et al. | 52/705 |

* cited by examiner

*Primary Examiner* — Joshua J Michener
*Assistant Examiner* — Theodore Adamos
(74) *Attorney, Agent, or Firm* — Donald R. Boys; Central Coast Patent Agency, Inc.

(57) ABSTRACT

A mount for a membrane roof is assembled from first and second metal plates coated on at least one side with heat-weldable material, at least one bolt and two sheets of membrane roofing material. The parts are assembled in a manner that the bolt faces upwards and is effectively sealed in the assembly against any leak around the bolt by a first sheet of roofing material. The mount may be attached to a roof by fasteners around the periphery of the first base plate, and the second sheet of membrane material seals the fasteners and fastener holes.

3 Claims, 9 Drawing Sheets

NON-PENETRATING ROOF MOUNT FOR A MEMBRANE ROOF

BACKGROUND OF THE INVENTION

1. Field of the Invention

The present invention is in the field of construction and pertains particularly to methods and apparatus for supporting equipment on a membrane roof.

2. Discussion of the State of the Art

In the field of construction, particularly roofing, membrane roofing as it is known in the art is becoming a staple for certain roof systems that formerly would be covered in asphalt or tar. Membrane roofing panels are typically available in sheets or rolls that may be cut to length and that may be secured to an unfinished roof surface, and heat welded together to form a unitary membrane.

Although there are a variety of membrane roofing materials available, more common compositions include Polyvinyl Chloride (PVC), Ketone Ethylene Ester (KEE), Chloro-Sulfonated Polyethylene (CSPE), Ethylene Propylene Diene Monomer (EPDM) and Thermoplastic PolyOlefin (TPO). Membrane roofing sheets may be adhered, setter nailed, stapled or otherwise fastened to an unfinished roof with an overlapping edge of an adjacent sheet heat welded over the fastener line to cover and seal the fasteners. Heat welding the panels together involves a surface-to-surface heating and fusion of the interfacing surfaces of adjacent panels or sheets, requiring a certain minimum temperature.

Membrane panels or sheets may be custom fabricated and may be offered in standard sizes. The material resiliency including flexibility may be designed into the product through varying the percentage of certain materials in the composite such as different percentages of rubber added to the composite.

Installing fixtures such as pipe brackets, solar panels, roof vents, air-conditioners, and other like accessories can be problematic after a membrane roof is installed, in that support structures designed to hold the fixtures in place are conventionally fastened to the roof over the membrane material, with fasteners penetrating the membrane material at each anchor point. Typically a sealant material is applied around penetrating fasteners to prevent leaking, but these materials are subject to weathering and tend to form leaks over time.

It has occurred to the inventor that such penetrations have a collective negative effect on the long-term viability of the roofing system in protection against leakage. Roof mastic or other after-market sealers do not last as long as the membrane materials of the roof systems and therefore periodic reapplication of such sealing products is often required to preserve the integrity of the system, or leaks are sure to occur.

It has also occurred to the inventor that certain mounting apparatus may require reinforcement such as by stacking and bonding plate materials forming the base of the apparatus wherein that reinforced apparatus may be fastened to the roof membrane using fasteners that penetrate, at least into the membrane roofing.

Therefore, what is clearly needed is a reinforced roof mount for supporting utilities on a membrane roof that includes a membrane covering for sealing off any exposed anchor points on the apparatus.

BRIEF SUMMARY OF THE INVENTION

In one embodiment of the invention a mounting assembly for a membrane roof is provided, comprising a first metal base plate coated on an upper surface with material compatible to heat weld to roofing membrane material, having length and width dimensions, and having a plurality of openings spaced around an outer periphery, a second metal base plate coated on at least an upper surface with membrane material and having length and width dimensions substantially smaller than the first metal base plate, and a substantially centered through opening, a bolt having a length, a head diameter larger than the diameter of the through opening in the second base plate and a threaded portion of a diameter to pass through the through opening, and a first sheet of roofing membrane material having length and width dimensions substantially larger than those of the second base plate and substantially smaller than those of the first base plate, the sheet of roofing membrane having a substantially centered through opening. The bolt is passed through the opening in the second metal base plate from below, the second metal base plate with the bolt is centered over and adhered to the first metal base plate, and the first sheet of roofing membrane is assembled over the threaded portion of the bolt and heat welded to the membrane coatings on both the first and the second metal base plates.

In one embodiment the first and second base plates are formed from pre-fabricated galvanized steel sheets pre-coated on one surface with the material compatible with heat welding to roofing membrane. Also ion one embodiment the material compatible to heat weld is one of Polyvinyl Chloride (PVC), Ketone Ethylene Ester (KEE), Chloro-Sulfonated Polyethylene (CSPE), Ethylene Propylene Diene Monomer (EPDM) or Thermoplastic PolyOlefin (TPO), or another known roofing membrane material. Still in one embodiment there is further a second sheet of membrane roofing material having length and width dimensions substantially larger than the dimensions of the first base plate and having a substantially centered cut out larger than dimensions than the first sheet of membrane and smaller than the first base plate, the second sheet of membrane shaped to cover the plurality of peripheral holes in the first base plate.

In one embodiment the second base plate is coated on both sides with the heat weld compatible material, and a second sheet of membrane material with dimensions smaller than those of the second base plate is heat welded to the back side of the second base plate, covering and sealing the bolt head. Also in one embodiment a plurality of bolts are assembled through openings in the second base plate. Still in one embodiment the bolt is welded in place to the metal of the second base plate. Further in one embodiment individual ones of the bolts are welded in place to the metal of the second base plate. And in one embodiment a plurality of second base plates with bolts are joined to a single first base plate.

In another aspect of the invention a method for providing a mounting bolt on a membrane roof is provided, comprising steps of forming a first metal base plate coated on an upper surface with a material compatible with heat welding to roofing membrane, the first metal base plate having length and width dimensions, and having a plurality of openings spaced around an outer periphery, forming a second metal base plate coated on an upper surface with the material compatible with heat welding to roofing membrane, the second metal base plate having length and width dimensions substantially smaller than the first metal base plate, and a substantially centered through opening, passing a bolt having a head larger than the through opening upward through the centered through opening of the second base plate, joining the second base plate to the first base plate by welding or adhesive, substantially centered on the first base plate, forming a first sheet of roofing membrane material having length and width dimensions substantially larger than those of the second base plate and substantially smaller than those of the first base plate and having a substantially centered through opening, and placing the first sheet of roofing membrane over the second base plate with the bolt through the through hole, and heat welding the first sheet of roofing membrane to both the second base plate and the first base plate, forming a mount assembly leaving the plurality of opening around the outer periphery of the first base plate uncovered.

In one embodiment the method further comprises fastening the mount assembly to the membrane surface of a membrane roof by fasteners through the plurality of holes around the outer periphery of the first base plate, forming a second sheet of roofing membrane having length and width dimensions substantially larger than the dimensions of the first base plate and having a substantially centered cut out larger than dimensions than the first sheet of membrane and smaller than the first base plate, the second sheet of membrane shaped to cover the plurality of peripheral holes in the first base plate, and placing the second sheet of roofing membrane over the mount assembly, covering the plurality of peripheral holes and the fasteners, and heat welding the second sheet of roofing membrane to both the first base plate and the membrane roof.

In one embodiment of the method the first and second base plates are formed from pre-fabricated galvanized steel sheets pre-coated on one surface with the material compatible with heat welding to roofing membrane. Also in one embodiment the compatible coating is one of Polyvinyl Chloride (PVC), Ketone Ethylene Ester (KEE), Chloro-Sulfonated Polyethylene (CSPE), Ethylene Propylene Diene Monomer (EPDM) or Thermoplastic PolyOlefin (TPO), or another known roofing membrane material. Also in one embodiment a plurality of mount assemblies having upward-extending bolts are formed to a membrane roof at points where bolts are needed to secure a piece of equipment to the membrane roof. Still in one embodiment the second base plate is coated on both sides with the heat weld compatible material, and a second sheet of membrane material with dimensions smaller than those of the second base plate is heat welded to the back side of the second base plate, covering and sealing the bolt head.

In one embodiment a plurality of bolts are assembled through openings in the second base plate. Also in one embodiment the bolt is welded in place to the metal of the second base plate. Also in one embodiment individual ones of the bolts are welded in place to the metal of the second base plate. And in one embodiment a plurality of second base plates with bolts are joined to a single first base plate.

DETAILED DESCRIPTION OF THE INVENTION

In various embodiments described in enabling detail below the inventor provides a unique roof mount and methods for facilitating mounting utilities on a membrane roof. The present invention is described using the following examples, which may describe more than one relevant embodiment falling within the scope of the invention.

Figure 1B:
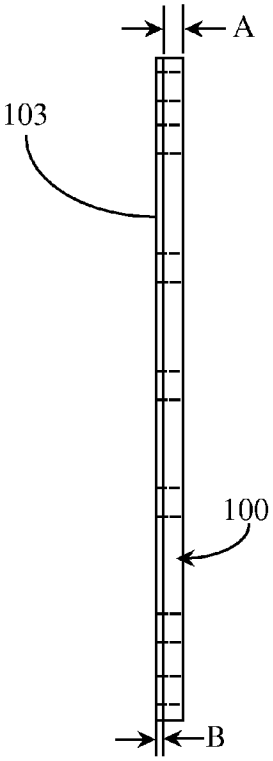
FIG. 1*b* is a side elevation view of the base plate of FIG. 1*a*.
Figure 1A:
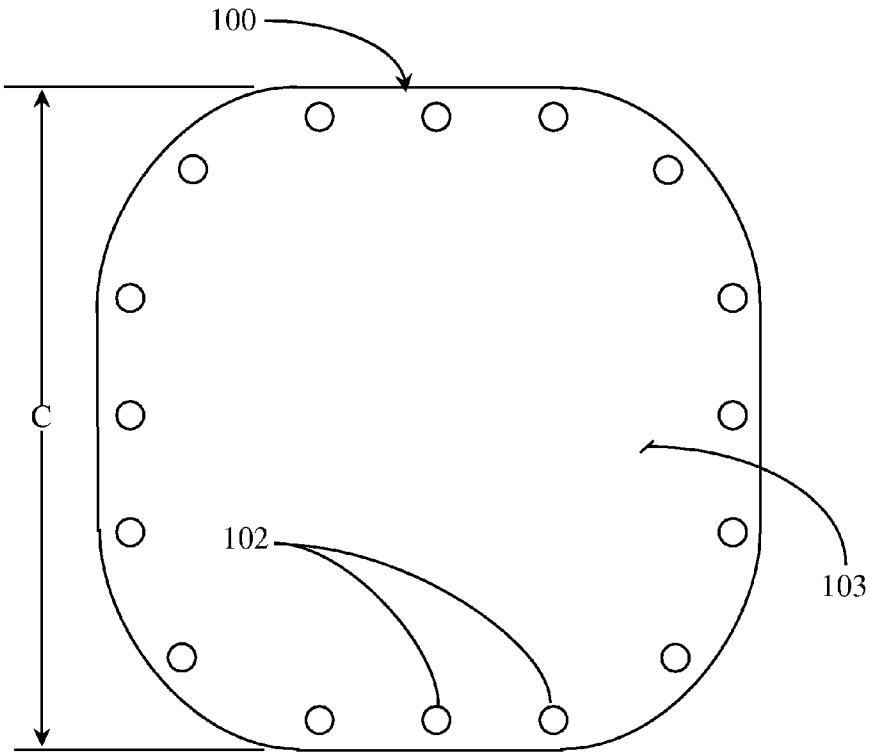
FIG. 1*a* is a plan view of a first base plate used in forming a roof mount according to an embodiment of the present invention.

FIG. 1 is an elevation with side view of a first base plate 100 used in forming a roof mount according to an embodiment of the present invention. Base plate 100 in one embodiment is formed from sheet metal that is coated on one side with a material 103 that may be heat welded to the membrane roof material. Material 103 may be Polyvinyl Chloride (PVC), Ketone Ethylene Ester (KEE), Chloro-Sulfonated Polyethylene (CSPE), Ethylene Propylene Diene Monomer (EPDM) and Thermoplastic PolyOlefin (TPO) without departing from the spirit and scope of the present invention, or any other membrane material known in the art.

The term membrane roof refers to a flexible resilient roof formed with panels of Polyvinyl Chloride (PVC), Ketone Ethylene Ester (KEE), Chloro-Sulfonated Polyethylene (CSPE), Ethylene Propylene Diene Monomer (EPDM) and Thermoplastic PolyOlefin (TPO), or any other membrane roofing material known in the art. Such materials may be heat welded together to fuse the roofing panels together presenting a leak-proof membrane covering. Membrane roofing is typically available in sheets or rolls that are fastened to an unfinished roof surface and then overlaid and heat-welded together, covering the fasteners on each successive panel to seal the covering over the roof.

An important material in membrane roofing is thermoplastic PolyOlefin (TPO) in examples described in this specification. However the present invention does not strictly depend on TPO for successful application. Therefore, other flexible or membrane type roofing materials may also be considered for heat weld such as Polyvinyl Chloride (PVC), Ketone Ethylene Ester (KEE), Chloro-Sulfonated Polyethylene (CSPE), or Ethylene Propylene Diene Monomer (EPDM), and other similar materials.

In one embodiment base plate 100 has multiple through holes 102 arranged in a peripheral edge pattern for accepting fasteners to anchor base plate 100 to structure underlying a membrane roof. Referring now to the side view, the metal portion of base plate 100 has a thickness dimension A. Dimension A may be a standard dimension of between one sixteenth of an inch and one eight of an inch. The pre-coated metal sheet may also be available in other thickness dimensions without departing from the spirit of the present invention. Pre-coating 103 has a thickness dimension B.

Base plate 100 in this example has an overall common length and width dimension C, reflecting a general geometric shape such as a square or a circle. However, base plate 100 may be provided in just about any geometric shape without departing from the spirit and scope of the invention. In this embodiment base plate 100 is in the shape of a square with rounded corners having a length and width (C). In other embodiments rectangular, annular, elliptical, and other shapes or patterns may be used.

Figure 2B:
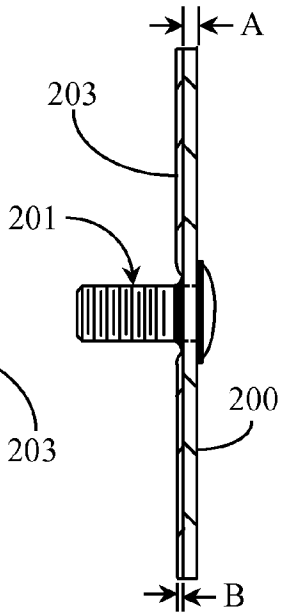
FIG. 2*b* is a side elevation view of the base plate of FIG. 2.
Figure 2A:
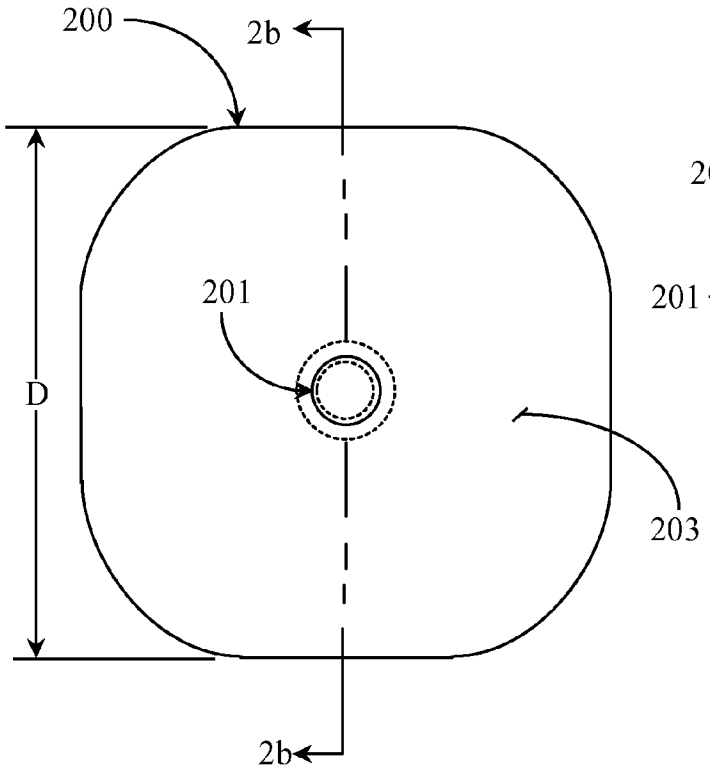
FIG. 2*a* is a plan view of a second base plate with a bolt used in forming the roof mount according to an embodiment of the invention

FIG. 2*a* is a plan view of a second base plate 200 including a bolt used in forming the roof mount in one embodiment. FIG. 2*b* is a side elevation view of the second base plate shown in FIG. 2*a*. Elements in FIG. 2*b* are shown in section, except for bolt 201, taken along section line 2*b*-2*b* of FIG. 2*a*. Second base plate 200 is formed from sheet metal that is pre-coated on one side with a material 203 that is heat weld able to a membrane roof, just as in the description above for base plate 100. Material 203 is analogous to material 103, and may be Polyvinyl Chloride (PVC), Ketone Ethylene Ester (KEE), Chloro-Sulfonated Polyethylene (CSPE), Ethylene Propylene Diene Monomer (EPDM) and Thermoplastic PolyOlefin (TPO) without departing from the spirit and scope of the present invention, or any other membrane material known in the art.

Referring again to FIGS. 2*a* and 2*b*, base plate 200 has a centrally located opening through which a bolt 201 is extended in the direction of the coated side of the base plate. Bolt 201 may be welded, brazed or soldered to the metal of plate 200 on one or both sides.

Referring now to FIG. 2*b*, the metal portion of second base plate 200 has a thickness dimension A. Dimension A may be a standard dimension of one sixteenth of an inch or one eight of an inch. The pre-coated sheet of metal may also be available in other thickness dimensions without departing from the spirit of the present invention. Pre-coating 203 has a thickness dimension B. Dimension B may be a standard coating thickness of one thirty second of an inch or less or more depending upon the application. In one embodiment the first base plate (100) and the second base plate (200) may be cut from the same piece of galvanized sheet metal having the same pre-coating material.

Base plate 200 has an overall length and width dimension D presenting a general geometric shape such as a square or a circle. However, base plate 200 may be provided in essentially any geometric shape without departing from the spirit and scope of the present invention. In this embodiment base plate 200 is in the shape of a rounded square having a length and width D. In other embodiments rectangular, annular, elliptical, and other shapes or patterns may be used.

In this embodiment dimension D is substantially smaller than dimension C of base plate 100. Base plate 200 may be affixed to the top surface of base plate 100, typically centrally located on base plate 100. The smaller dimension of base plate 200 allows perforations 102 in base plate 101 to remain exposed for fastening purposes. More detail about assembling the roof mount is provided later in this specification.

Figure 3:
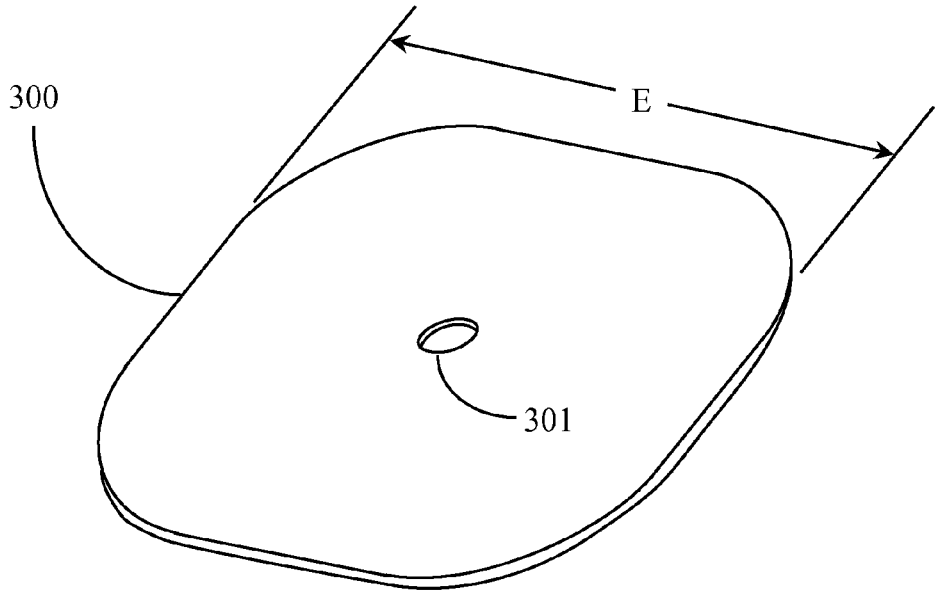
FIG. 3 is a perspective view of a first piece of membrane material for heat weld over the top of the first and second base plates in assembly.

FIG. 3 is a perspective view of a first piece of membrane material 300 for heat welding over the top of the first and second base plates in assembly. Membrane material 300 may be precut from a sheet of membrane roofing material used to cover an unfinished roof. Membrane material 300 will then have the same thickness as the membrane panels used to form the roof. Membrane material 300 may be provided in other thickness dimensions as well without departing from the spirit and scope of the present invention.

Membrane material 300 may be formed of Polyvinyl Chloride (PVC), Ketone Ethylene Ester (KEE), Chloro-Sulfonated Polyethylene (CSPE), Ethylene Propylene Diene Monomer (EPDM) and Thermoplastic PolyOlefin (TPO), or any other membrane roofing material without departing from the spirit and scope of the present invention. Membrane material 300 has a through opening 301 for placing over bolt 201. The diameter of opening 301 may be somewhat greater than the bolt diameter.

In one embodiment membrane piece 300 has a (length/width) dimension E that is substantially larger than the overall dimension D of the second base plate and substantially smaller than dimension C of the first base plate. Dimension E is the same (length and width), in this embodiment, reflecting a general geometric shape such as a square or a circle. However, membrane piece 300 may be provided of any geometric shape without departing from the spirit and scope of the present invention. In this embodiment membrane piece 300 is in the shape of a rounded square having a length and width (E). In other embodiments rectangular, annular, elliptical, and other shapes or patterns may be used.

Membrane piece 300 may be laid over the roof mount assembly (first and second base plates) and heat welded to the base plates, covering second base plate 200 and a portion of base plate 100. Membrane 300 may be welded to the entire surface coating of the second base plate and the first base plate short of covering the multiple perforations around the periphery of the first base plate.

Figure 4:
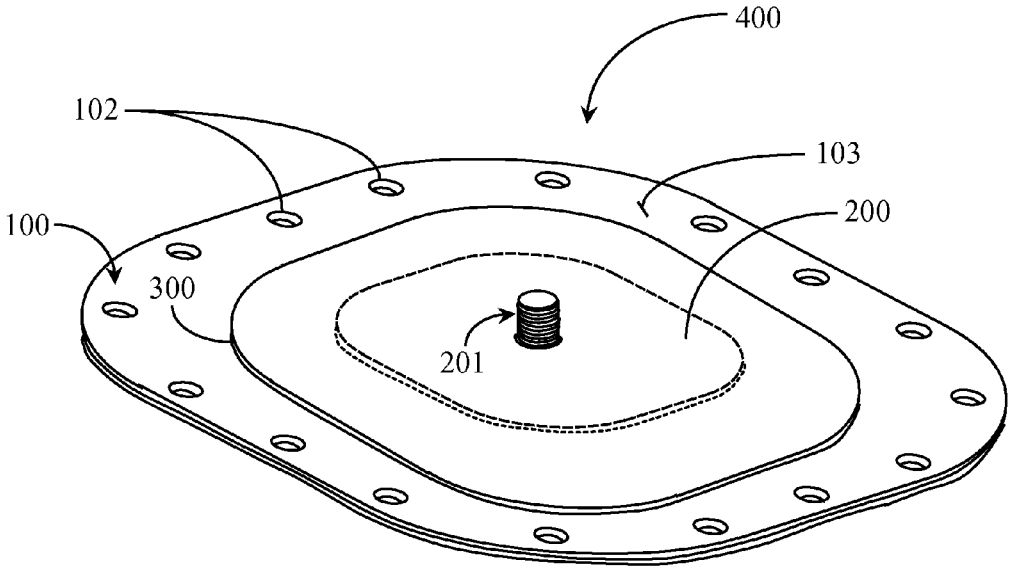
FIG. 4 is a perspective view of a roof mount containing the first and second base plates covered with the first piece of membrane material.

FIG. 4 is a perspective view of a roof mount 400 assembled from the first and second base plates, including the extended threaded bolt 201, with first piece (300) of membrane material heat welded to the first and second base plates. Roof mount 400 is illustrated in assembly depicting base plate 100 with pre-coating 103 facing upward. Multiple perforations 102 are exposed for fastening roof mount 400 to structure underlying membrane roofing material. In one embodiment base plate 200 is bonded to the top surface of base plate 100 with the pre-coated side and threaded bolt facing up. The bond may be achieved using an industrial adhesive or in another manner, such as by welding. Membrane piece 300 is heat welded to base plate 100 and to base plate 200.

Stacking the second base plate over the first base plate in assembly of roof mount 400 provides extra durability for the mounting location (bolt holes). Roof mount 400 may be prepared in advance before sheet roofing is applied to the unfinished roof, and may be fastened to the roof over the membrane surface using conventional fasteners inserted through multiple peripheral perforations 102 provided for that purpose.

In general a process for creating and preparing roof mount 400 for installation includes cutting out the first and second base plates from a sheet of galvanized sheet metal pre-coated on one with membrane material. A step for placing through openings in the first and second base plates may be performed before or after the pieces are cut or stamped out of the sheet metal material.

Bolt is placed through the second base plate, then the second base plate is placed over the first base plate and is bonded to the top surface of the first base plate (pre-coating facing up). Membrane piece 300 may be precut from roofing or other sheet membrane material and may have bolt opening(s) placed there through before or after the second base plate is affixed to the first base plate. Membrane piece 300 is then positioned over the first and second base plates and heat welded to cover the surface areas of both plates save for the area on the first base plate containing perforations for fasteners.

In this example, the outer edge of membrane piece 300 lies past or covers the second base plate (200) on all sides, but ends short of interfering with openings 102 in first base plate 100. Perforations 102 may be added to base plate 100 before or after the two base plates are joined and covered with the first piece of membrane.

Figure 5:
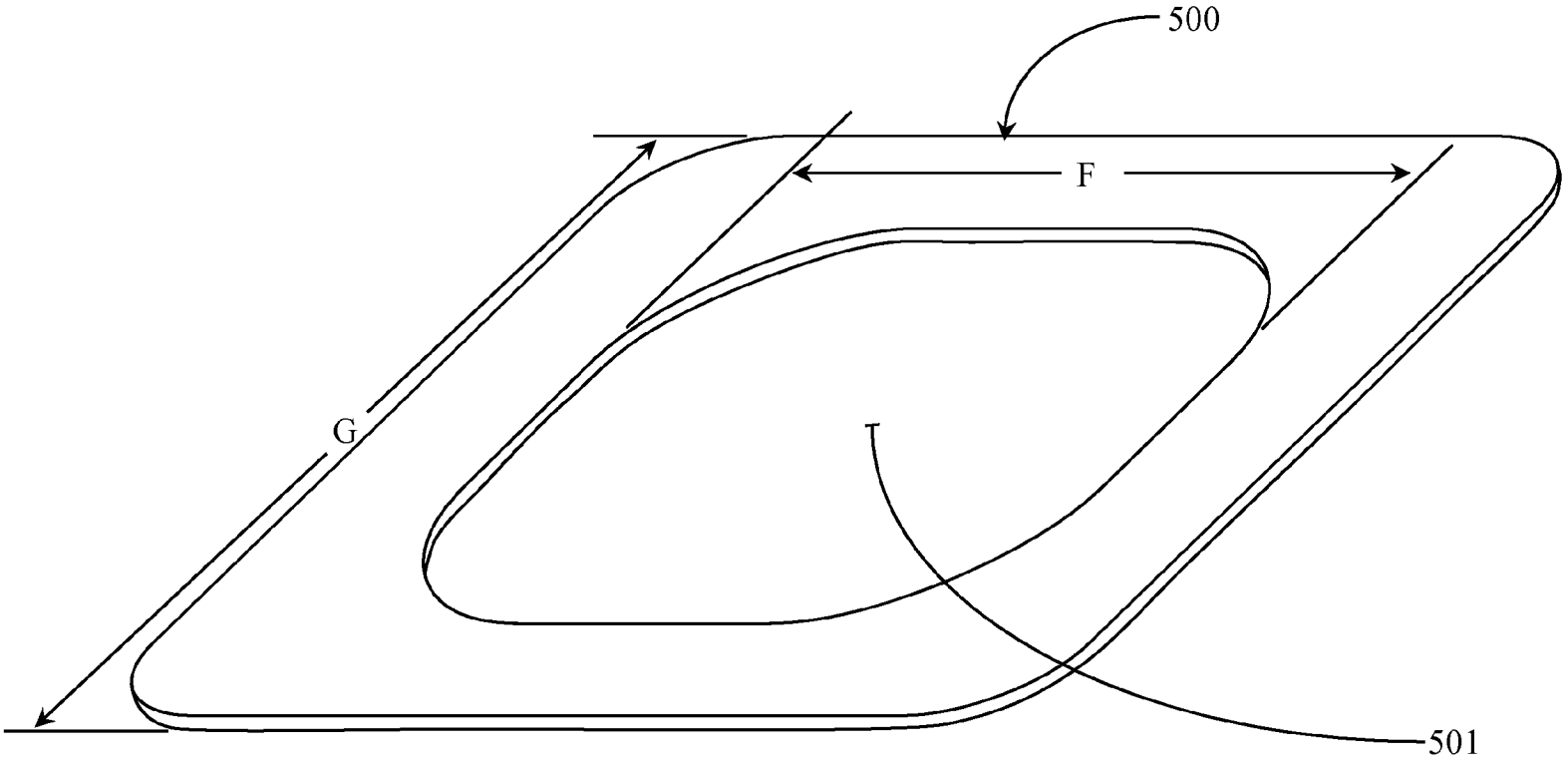
FIG. 5 is a perspective view of a second piece of membrane material for heat weld over the roof mount to a membrane roof surface.

FIG. 5 is a perspective view of a second piece of membrane material 500 for heat welding over the roof mount shown in FIG. 4 to a membrane roof surface. Membrane material 500 may be Polyvinyl Chloride (PVC), Ketone Ethylene Ester (KEE), Chloro-Sulfonated Polyethylene (CSPE), Ethylene Propylene Diene Monomer (EPDM) or Thermoplastic Poly-Olefin (TPO) without departing from the spirit and scope of the present invention, or any other membrane material known in the art.

Second membrane piece 500 has a large cutout portion 501 to provide relief clearance for the area occupied by the second base plate. Cutout portion 501 has a major width/length dimension F in one embodiment. Dimension F is larger than dimension D of the second base plate and smaller than dimension C of the first base plate. In one embodiment the membrane material piece cut out to leave area 501 may serve as the first piece of membrane material 300 for heat weld to the first base plate.

Dimension G of membrane piece 500 is substantially larger than dimension C of the first base plate to allow for sufficient heat weld surface area when applying the roof mount to a membrane roof surface. The geometric shape of cutout portion 501 may vary without departing from the spirit and scope of the present invention. In this embodiment second membrane piece 501 is rectangular with rounded corners as is the center cutout portion. It is not required that the geometric shape profile of membrane piece 501 be identical or similar to the overall geometric profile of roof mount 400 in order to practice the invention.

Membrane piece 501 may be applied over an installed roof mount to seal the roof mount to the surrounding membrane roof. Membrane piece 500 covers the fastening perforations in the first base plate sealing over those perforations to protect against leaks at the fastening points.

Figure 6:
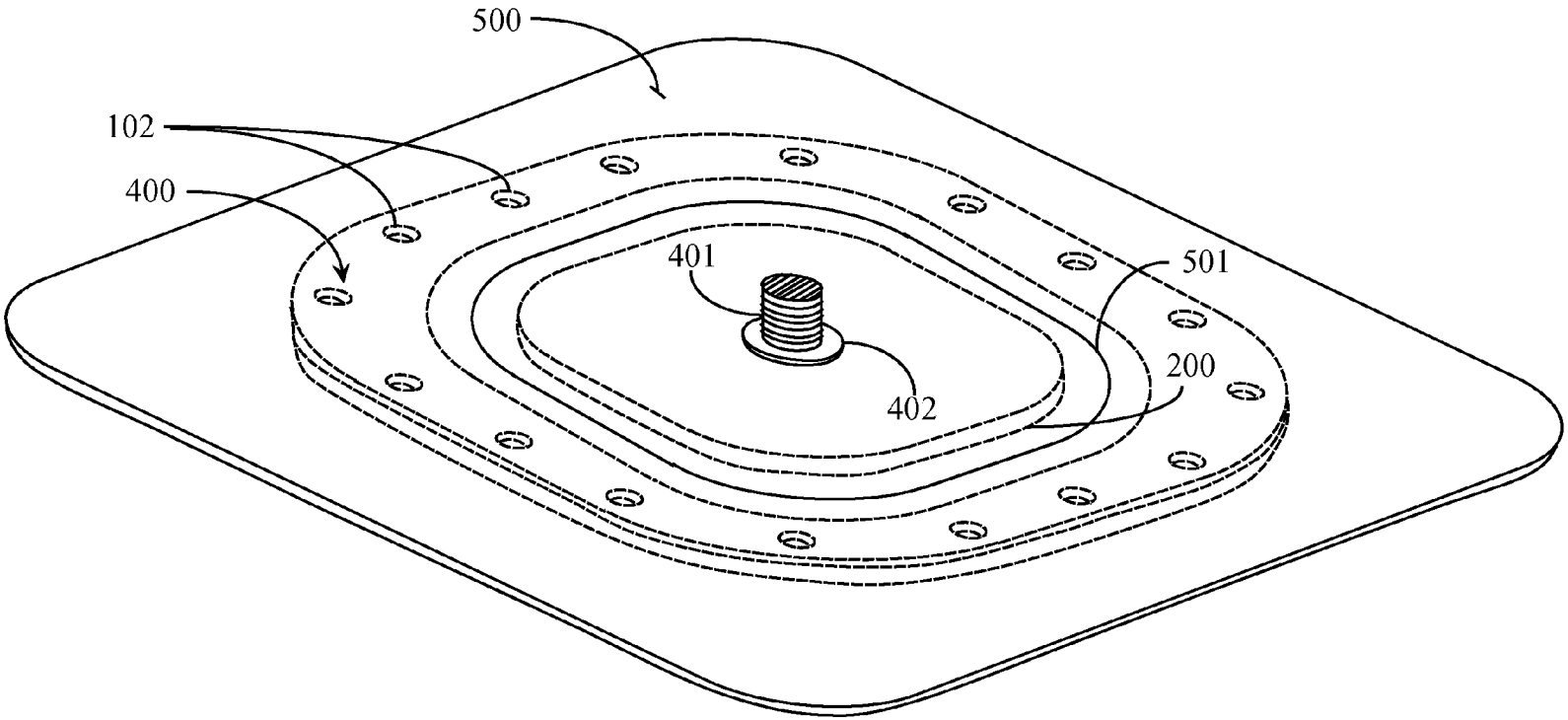
FIG. 6 is a perspective view of the roof mount with the second piece of membrane attached thereto in position for installation on a membrane roof.

FIG. 6 is a perspective view of the roof mount of FIG. 4 with the second piece of membrane attached thereto in position for installation on a membrane roof. Membrane piece 500 is used to seal roof mount 400 after it is fastened to the roof through the membrane roofing. In this embodiment the inner edge of cut out portion 500 defining area 501 is heat welded over the outer edge of the first piece of membrane material (broken boundary). The rest of piece 500 covers perforations 102 (fasteners not shown) and extends over the surrounding roof on all sides or the roof mount, where it is heat welded to the membrane roof surface.

In general application, a roof mount such as roof mount 400 may be positioned or placed at any desired location on a membrane roof and fastened down to the roof surface through the membrane. After fasteners are used to secure the roof mount, membrane piece 500 may be heat welded to the roof mount and onto the surrounding roof surface to ensure leak-proof installation and to further stabilize the installation. Exact shapes and hole patterns as well as thickness of materials (metal, membrane and coatings) may vary according to what is actually mounted to the roof using the roof mount.

Figure 7:
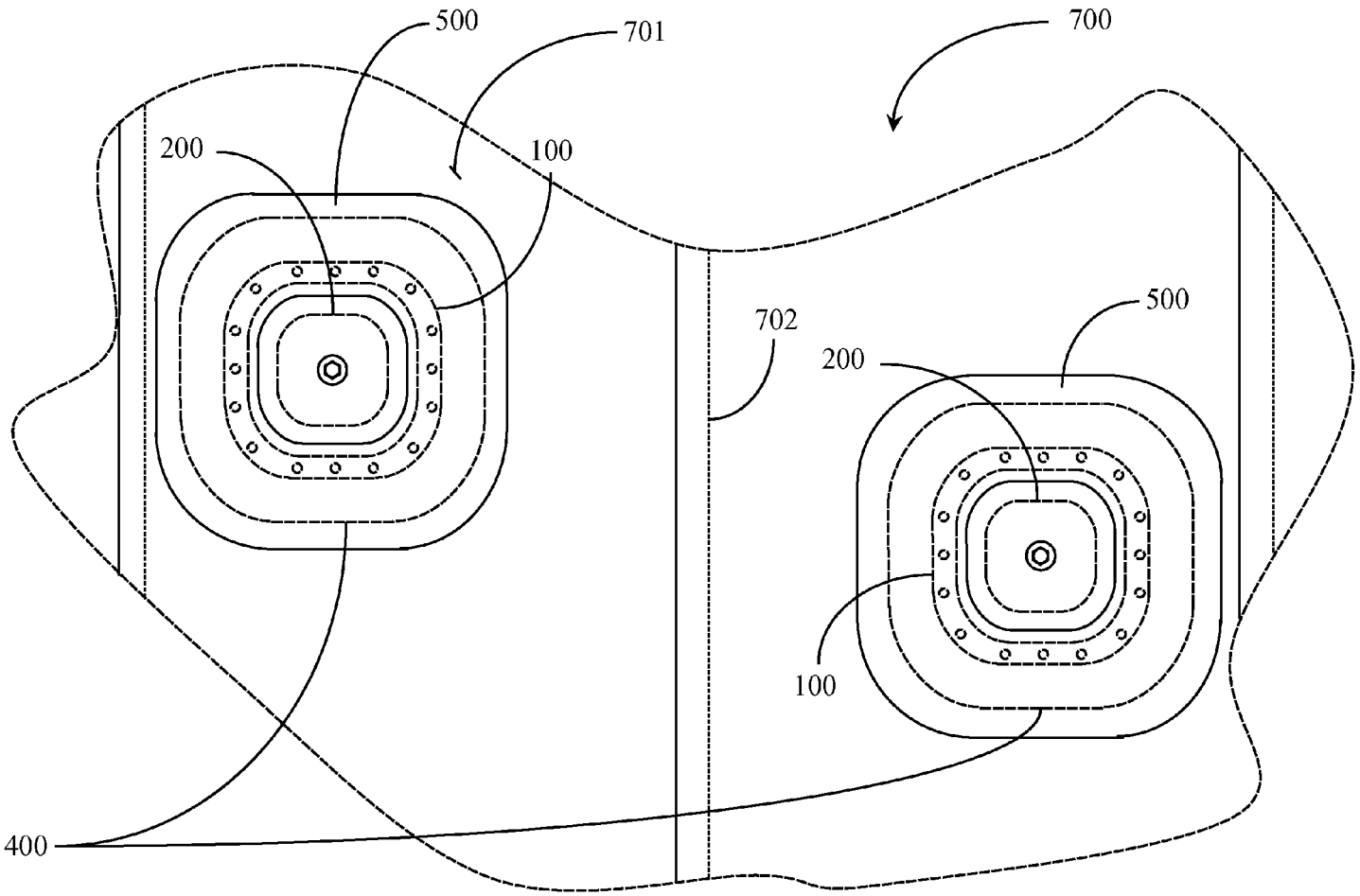
FIG. 7 is an overhead view of a section of a membrane roof supporting installed roof mounts according to an embodiment of the present invention.

FIG. 7 is an overhead view of a section of a membrane roof 700 supporting two installed roof mounts 400 according to an embodiment of the present invention. Roof section 700 is laid over an unfinished roof surface using precut flexible roofing sheets 701. Roof section 700 includes roof panels or sheets 701 formed of one of Polyvinyl Chloride (PVC), Ketone Ethylene Ester (KEE), Chloro-Sulfonated Polyethylene (CSPE), Ethylene Propylene Diene Monomer (EPDM) and Thermoplastic PolyOlefin (TPO) or other membrane roofing material.

Roofing sheets 701 are rolled out lengthwise and fastened (typically one edge) to the roof surface with subsequent sheets laid over the previous sheets to cover the fasteners illustrated herein as fasteners 702. In some cases fasteners are not used, and edges or other areas are secured to the underlying structure with adhesive. The overlapping area of a sheet of membrane is heat welded over the fasteners of each sheet installed to ensure watertight seal. Typically, wall or vertical covering is performed with the same material as the horizontal covering and wall sheets have adjacent edges overlapping and heat welded over the fastening lines of the edge panels or sheets on the horizontal surface or floor of the roof.

Roofing section 700 includes two roof mounts 400 installed over the membrane roof surface, each sealed by a membrane piece 500. The profiles of base plates 100 and 200 are visible in this depiction as broken boundaries. The inner edge of the second piece of membrane is visible as a solid boundary situated between the outer edge of the second base plate and the outer edge of the first piece of membrane. It is noted herein that roof mounts of the present invention may be secured to horizontal, sloping, and to vertical surfaces without departing from the spirit and scope of the present invention. The bolts are exposed for receiving fixture or equipment brackets or apparatus that secure the equipment to the roof mount. Examples of the types of utilities served may include communications and satellite equipment, solar equipment, heating and air equipment, water tanks, and any other type of structure.

In most embodiments of the present invention there are more than one roof mount used to mount a utility to a membrane roof. For example, there may be four roof mounts positioned to accept a utility having four vertical mounting posts. It is also noted herein that roof mounts of the present invention may be used to add further structure to a membrane roof surface in areas that are supportive of the additional weight without creating penetration areas that must be roofed over or sealed with roofing patch materials to cover the penetrated or exposed areas. There are many possibilities.

Figure 8B:
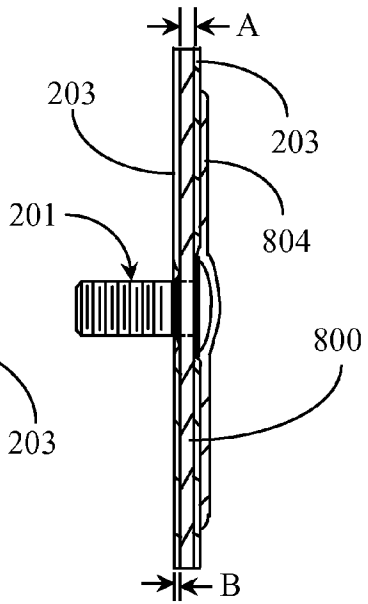
FIG. 8*b* is a side elevation view of the base plate of FIG. 8*a*.
Figure 8A:
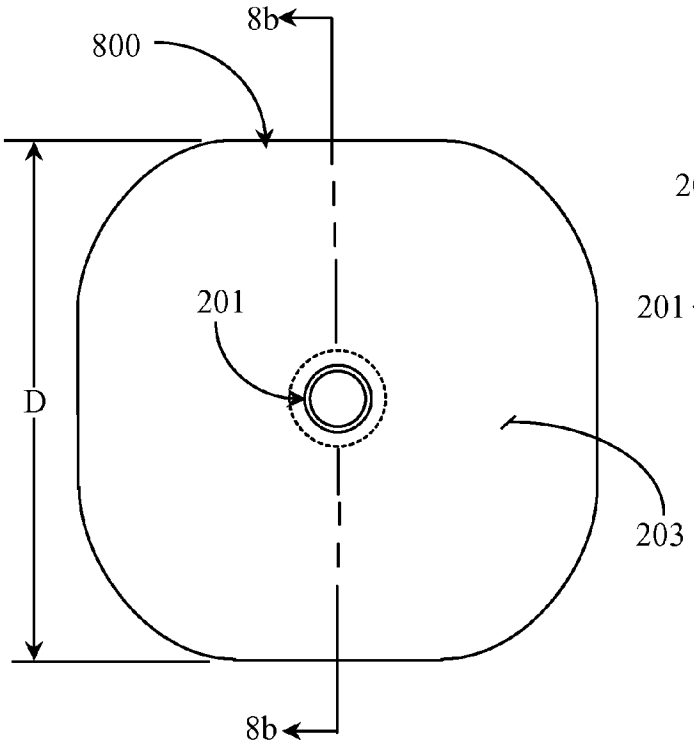
FIG. 8*a* is a plan view of a first base plate 800 in an alternative embodiment of the invention.

FIGS. 8*a* and 8*b* illustrate a second base plate 800 in an alternative embodiment of the present invention. In this embodiment base plate 800 is coated on both sides with material 203 compatible with heat welding to membrane, instead of on just the side in the direction of extension of the bolt. This difference allows an extra piece of membrane material 801 to be applied and heat welded to the backside of base plate 800, covering the head of bolt 201, providing extra sealing protection for the openings through which the bolt passes in assembly. The assembly is shown in cross-section view 8*b*, taken along section line 8*b*-8*b* of FIG. 8*a*. The bolt itself is not shown in section.

In yet another alternative embodiment there may be a plurality of bolts extending from one roof mount assembly. This may be done by providing more than one bolt through a single second base plate 200, or by providing a plurality of base plates 200, all joined to a single first base plate in any pattern by adhesive or other joining technique. To accommodate a plurality of second base plates the first base plate may be made in any appropriate size.

Figure 9B:
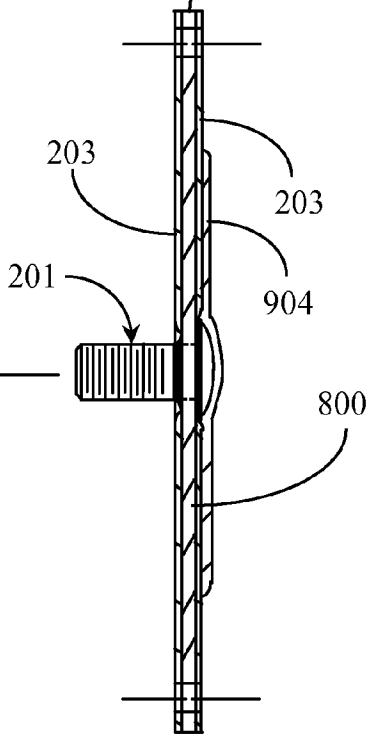
FIG. 9*b* is a section view of the assembly of FIG. 9*a* taken along the section line 9*b*-9*b*.
Figure 9A:
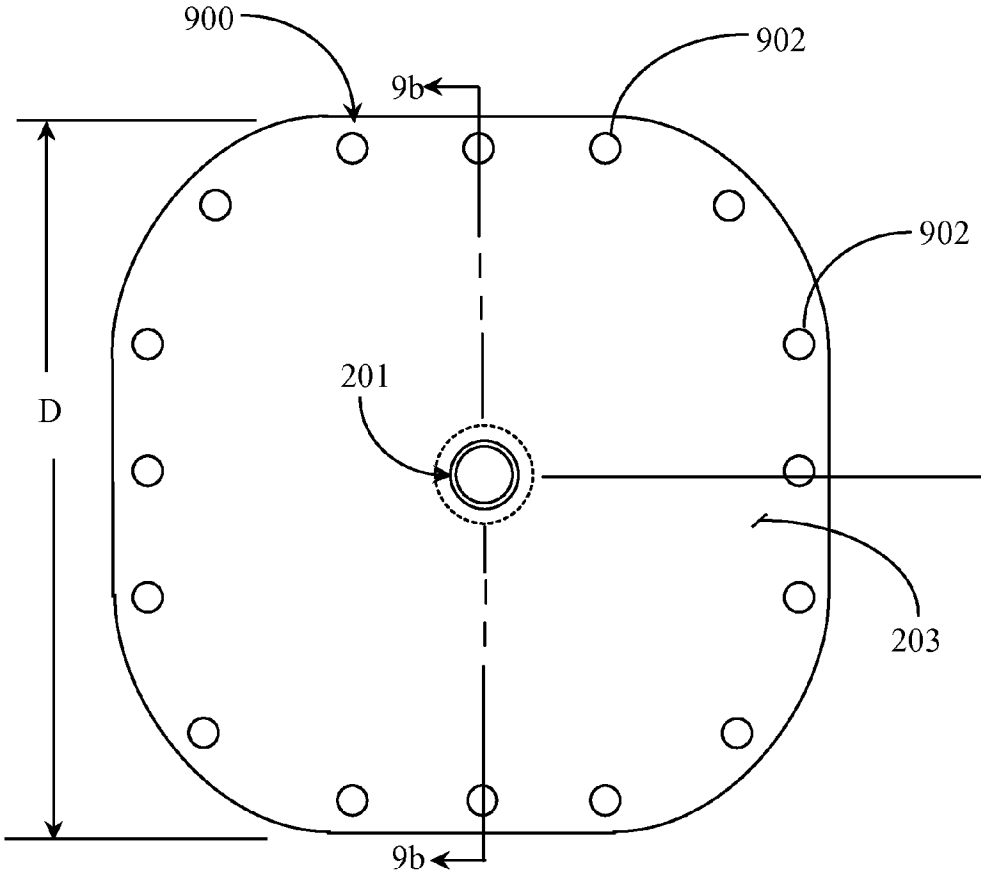
FIG. 9*a* is a plan view of a base plate and assembly in another embodiment of the invention.

FIGS. 9*a* and 9*b* illustrate yet another embodiment of the invention. FIG. 9*a* is a plan view of an assembly 900 comprising a base plate 900 coated on both sides with a coating 203 of material compatible with heat-welding to membrane roofing material as described above in several instances. Base plate 900 has a pattern of holes 902 around the outer periphery, provided for fastening the assembly to structure under a membrane roof surface, just as described above for the assembly described with reference to FIG. 4. Base plate 901 has a bolt 201 passed through a hole in the center of the base plate. In alternative embodiments the hole and bolt may be off-center, and in some cases there may be more than one bolt through more than one hole. The bolt or bolts may be welded to the metal of base plate 901 on either or both sides, or may be adhered to the base plate in another manner. With the bolt or bolts in place a piece of membrane roofing material 904 is heat welded to material 203 over the bolt head on the backside of the assembly, effectively sealing any passage for moisture around the bolt. When finished, assembly 900 is equivalent to the assembly described with reference to FIG. 4 above, but with fewer parts and less labor to assemble. Assembly 900 may then be fastened to a membrane roof wherever bolts are needed by fasteners through holes 902. Once fastened to a roof, final sealing of holes 902 is accomplished by another piece of membrane roofing material just as described with reference to FIGS. 5 and 6 above.

It will be apparent to the skilled person that the dimensions and shape of the of the base plate may be varied, and there may be a plurality of bolts passed through a single base plate, and the plurality of bolts may be sealed to the base plate by one or more than one sheets of membrane material heat-welded to the base plate over the bolt heads.

It will be apparent to one with skill in the art that the roof mount installation system of the invention may be provided using some or all of the mentioned features and components without departing from the spirit and scope of the present invention. It will also be apparent to the skilled artisan that the embodiments described above are specific examples of a single broader invention that may have greater scope than any of the singular descriptions taught. There may be many alterations made in the descriptions without departing from the spirit and scope of the present invention.

It will also be apparent to the skilled person that the arrangement of elements and functionality for the invention is described in different embodiments in which each is exemplary of an implementation of the invention. These exemplary descriptions do not preclude other implementations and use cases not described in detail. The elements and functions may vary, as there are a variety of ways the hardware may be implemented and in which the software may be provided within the scope of the invention. The invention is limited only by the breadth of the claims below.

The invention claimed is:

1. A mounting assembly for a membrane roof, consisting of:

a first metal base plate coated on an upper surface with material compatible to heat weld to roofing membrane material, having length and width dimensions, and having a plurality of openings spaced around an outer periphery;

a second metal base plate coated on at least an upper surface with membrane material and having length and width dimensions substantially smaller than the first metal base plate, and a substantially centered through opening;

a bolt having a length, a head diameter larger than the diameter of the through opening in the second base plate and a threaded portion of a diameter to pass through the through opening; and a first sheet of roofing membrane material having length and width dimensions substantially larger than those of the second base plate and substantially smaller than those of the first base plate, the sheet of roofing membrane having a substantially centered through opening;

wherein the bolt is passed through the through opening in the second metal base plate from below, the second metal base plate with the bolt is centered over and adhered by welding or adhesive to the first metal base plate, and the first sheet of roofing membrane material is assembled over the threaded portion of the bolt and heat welded to the membrane coatings on both the first and the second metal base plates, leaving the plurality of openings spaced around the outer periphery of the first base plate exposed, providing an assembly ready to be mounted to a membrane roof.

2. The mounting assembly of claim 1 wherein the first and second base plates are formed from pre-fabricated galvanized steel sheets pre-coated on one surface with the material compatible with heat welding to roofing membrane.

3. The mounting assembly of claim 2 wherein the material compatible to heat weld is one of Polyvinyl Chloride (PVC), Ketone Ethylene Ester (KEE), Chloro-Sulfonated Polyethylene (CSPE), Ethylene Propylene Diene Monomer (EPDM) or Thermoplastic PolyOlefin (TPO).

* * * * *